US008414394B2

(12) United States Patent
Kovacic et al.

(10) Patent No.: US 8,414,394 B2
(45) Date of Patent: Apr. 9, 2013

(54) CONFIGURABLE USER INTERFACE FOR A GAMING APPARATUS

(75) Inventors: Marijan Jon Kovacic, Lane Cove (AU); Martin Kenneth Leach, Lane Cove (AU)

(73) Assignee: Aristocrat Technologies Austraila Pty Ltd (AU)

( * ) Notice: Subject to any disclaimer, the term of this patent is extended or adjusted under 35 U.S.C. 154(b) by 837 days.

(21) Appl. No.: 11/749,003

(22) Filed: May 15, 2007

(65) Prior Publication Data

US 2008/0058103 A1 Mar. 6, 2008

(30) Foreign Application Priority Data

May 16, 2006 (AU) ..... 2006902600

(51) Int. Cl.
*A63F 9/24* (2006.01)

(52) U.S. Cl.
USPC ..... 463/37

(58) Field of Classification Search ..... 463/16–20, 463/37
See application file for complete search history.

(56) References Cited

U.S. PATENT DOCUMENTS

| | | | | |
|---|---|---|---|---|
| 5,342,047 | A | 8/1994 | Heidel et al. | |
| 5,951,397 | A | 9/1999 | Dickinson | |
| 2003/0064807 | A1 * | 4/2003 | Walker et al. | 463/42 |
| 2003/0069070 | A1 | 4/2003 | Alcorn et al. | |
| 2003/0224852 | A1 * | 12/2003 | Walker et al. | 463/20 |
| 2003/0228902 | A1 * | 12/2003 | Walker et al. | 463/25 |
| 2005/0282615 | A1 | 12/2005 | Englman et al. | |
| 2006/0183536 | A1 * | 8/2006 | Gagner et al. | 463/26 |

OTHER PUBLICATIONS

European Search Report corresponding to European Patent Application No. 07108197, completed Feb. 26, 2008, 2 pages.

* cited by examiner

*Primary Examiner* — David L Lewis
*Assistant Examiner* — Eric M Thomas
(74) *Attorney, Agent, or Firm* — McAndrews, Held & Malloy, Ltd.

(57) ABSTRACT

A programmed controller of a gaming console is disclosed. The controller controls play of a game in which a plurality of symbols are selected to form one or more outcomes and selectively operates in a first mode and a second mode of operation. In the first mode of operation a user interface comprises a combination of a touch screen on the display and physical buttons on the gaming apparatus. In the second mode of operation the user interface comprises only physical buttons. Also disclosed is a gaming system including a network and a method of configuring a gaming machine.

14 Claims, 8 Drawing Sheets

CONFIGURABLE USER INTERFACE FOR A GAMING APPARATUS

RELATED APPLICATIONS

This application claims priority to an Australian patent application filed on May 16 2006, as serial number AU2006902600 entitled "Configurable User Interface for a Gaming Apparatus," which is herein incorporated by reference in its entirety.

TECHNICAL FIELD

The present invention relates to a gaming machines and apparatus and to methods of providing a gaming machine. In particular, the present invention relates to a user interface for a gaming machine and to methods of providing a user interface on a gaming machine.

BACKGROUND OF THE INVENTION

With the increase of gambling at gaming venues has come increased competition between gaming venues to obtain a larger share of the total gambling spend. Gaming venue operators have therefore continuously looked for new variations and types of games in order to attract both new and return customers to their venues.

In response to this need, suppliers of gaming devices and systems have attempted to provide the sought after variety. There has been a trend in recent years to provide increasing variations in the types of games offered on gaming machines and to provide games with more complex game play or options. Variation in the way that the games operate and are controlled requires the provision of different user interfaces for different games.

In addition, the variation in the user interface between games is a problem when multiple games are offered on a single gaming machine. This problem becomes even more apparent if the gaming apparatus is connected to a network and games can be downloaded from a game server, or played remotely, because potentially thousands of games could be available to be played at the gaming apparatus.

One solution to the problem of different games requiring a different user interface is to implement the user interface as a touch screen. When a touch screen is used, different games can display different indicia to represent the touch pads.

One problem with touch screens is that they are often not as comfortable or easy to use as traditional push buttons. Another problem is that touch screens to date are generally not as reliable as physical push buttons and a player may experience frustration if a touch screen does not register all touches of the screen. In addition, there may be more probability of a player inadvertently touching an incorrect button when using a touch screen in comparison to when physical buttons are used, which for some games may lead to the player wagering an amount that they did not wish to risk. This may lead to the player experiencing frustration and bad will towards the gaming machine operator. A still further problem with touch screens is that they are relatively expensive to replace upon failure.

SUMMARY OF THE INVENTION

According to a first aspect of the present invention, there is provided a programmed controller of a gaming console, wherein the controller is programmed so as to:

receive information relating to a player input provided through a user interface in communication with the controller;

dependent in part on the player input, control play of a game in which a plurality of symbols are selected to form one or more outcomes;

if at least one particular outcome results in the game, cause the award of an award;

cause a display to display representations of the game; and selectively operate in a first mode and a second mode of operation;

wherein when the programmed controller operates in the first mode of operation, the user interface comprises a combination of a touch screen on the display and physical buttons on the gaming apparatus, and when the programmed controller operates in the second mode of operation, the user interface comprises only physical buttons.

In one embodiment in the first mode of operation, the touch screen implements game bet selectors and the physical buttons implement a game play activator. In this embodiment, the game bet selectors may be the only selectors implemented using the touch screen.

In one embodiment, the programmed controller is further programmed so as to enter a configuration mode when a particular input is received, wherein in response to receipt of a further particular input when in the configuration mode, the programmed controller is configured to operate in either the first mode of operation or the second mode of operation.

In another embodiment, the programmed controller is further programmed so as to automatically detect a type of user interface provided on a gaming console on which the programmed controller is to implement a game and operate in either the first or the second mode of operation dependent on the detected type of user interface.

According to a second aspect of the present invention, there is provided a programmed game controller for a gaming console, wherein the controller is programmed so as to:

receive through a user interface in communication with the programmed controller a selection of a number of outcomes of a game on which a player stakes a wager and a selection of the size of the wager staked on each outcome;

dependent in part on the received selections, control play of a game to form a plurality of outcomes and cause a plurality of symbols representing the outcomes to be displayed on a display to represent each outcome;

if an outcome on which the player has staked a wager is a winning outcome, cause the award of an award; and selectively operate in one of a first mode of operation and a second mode of operation;

wherein in the first mode of operation the game controller:

detects operation of a touch screen provided over the display and determines from operation of the touch screen the number of outcomes on which a player stakes a wager and the size of the wager per outcome, and causes the display to display behind the touch screen wagering buttons with explanatory information that indicate how the touch screen should be operated to stake a particular wager; and detects actuation of a physical button and plays a game in accordance with a wager previously specified by operation of the touch screen upon actuation of the physical button;

and wherein in the second mode of operation the game controller:

does not cause the display to display the wagering buttons;

detects actuations of buttons in a bank of physical buttons;

determines from actuations of the buttons in the bank of physical buttons the number of outcomes on which a player stakes a wager and the size of the wager per outcome; and plays a game in accordance with a specified wager upon actuation of the one of the buttons in the bank of physical buttons.

In one embodiment, when the wagering buttons and explanatory information are displayed, the programmed controller causes them to be displayed on a portion of the screen that is not occupied by any symbols representing the outcomes of the game and wherein when the wagering buttons and explanatory information are not displayed, the only change made to the images displayed on the display is the display of images in the location where the wagering buttons and explanatory information would be displayed.

In one embodiment, the user interface of the first type of console also comprises a touch screen, the n selectors refer only to the required game bet selectors and a game play actuator, and wherein the programmed game controller is:

programmed to provide the game on the first type of console implementing the n selectors using the physical selectors and without using the touch screen, and implement other selectors using one or both of physical selectors and selectors implemented using the touch screen; and programmed to provide the game on the second type of console by implementing the game play actuator as a physical selector and the other of the n selectors using the touch screen.

In one embodiment, the game controller recognises inputs from a game play activator that is a physical selector when configured to operate on both the first and second types of consoles.

According to a third aspect of the invention, there is provided a programmed game controller for a gaming console, wherein the controller is programmed so as to provide a game that requires inputs from n buttons and is programmed so as to be configurable to provide said game:

on a first type of console comprising a user interface including a display and at least n physical buttons; and on a second type of console comprising a user interface including a display, at least one and less than n physical buttons, and a touch screen over the display;

wherein when the game controller is configured to provide the game on the second type of console, the game controller causes selectors to be displayed on the display of the second type of console and recognises inputs from the touch screen indicating selection of the selectors, so that sum of the number of the selectors and physical buttons on the second type of console is at least n.

In one embodiment, all options for wagering on the game are available when the game is provided on the first type of console and the second type of console.

In one embodiment, the game controller does not cause the selectors to be displayed when the gem controller is configured to operate on the first type of console.

In one embodiment, the programmed game controller is further programmed so as to detect whether it is providing a game on the first type of console or the second type of console and automatically configure dependent on the detection.

In one embodiment, when the selectors are displayed, they are displayed over a game screen of the game and wherein at least part of the selectors are displayed transparently or translucently so that images in the game screen can be viewed there through.

In either the first or the second aspects of the invention, the game may be one of a plurality of games that the programmed controller is programmed to provide, each of the plurality of games being controlled in part dependent on inputs received from the user interface and wherein the controller is programmed to selectively operate in either the first mode of operation or the second mode of operation for every on of the plurality of games.

According to a fourth aspect of the present invention, there is provided a gaming system comprising a computer server in communication with a plurality of gaming consoles and a database containing a plurality of game programs, each game program, when executed by a game controller in the gaming system, providing a game in which a plurality of symbols are selected to form one or more outcomes that are caused to be represented on a display and if a particular outcome results the game controller caused the award of an award, wherein at least one of said plurality of game programs includes instructions to cause a game controller to operate in either a first mode in which the game controller receives inputs from a user interface implemented in part as a touch screen and in part using another interface device or in a second mode in which the game controller receives inputs from a user interface implemented without using a touch screen.

In one embodiment, the at least one game program includes instructions to cause a game controller to enter a configuration mode when a particular input is received, wherein the mode of operation in which the program operates the game controller is dependent on a further particular input received when the game controller is in the configuration mode.

In another embodiment, the at least one game program includes instructions to automatically detect a type of user interface provided on a gaming console on which the programmed controller is to implement a game and operate in either the first or the second modes of operation dependent on the detected type of user interface.

In one embodiment, when the user interface is implemented in part as a touch screen, that part comprises a game bet selector. In this embodiment, the game controller may receive inputs from a physical button to activate each game play of the game provided by each of the game programs.

According to a fifth aspect of the invention, there is provided a gaming system comprising a computer server in communication with both a plurality of gaming consoles and a database containing a plurality of game programs, wherein each of the game programs, when executed by a game controller in the gaming network, provides a game on a said console in which a plurality of symbols are selected to form one or more outcomes and if a particular outcome results an award is awarded, wherein the plurality of gaming consoles comprise at least one console of a first type and at least one console of a second type, the first type of console comprising a user interface including a first number of physical selectors, and the second type of console comprising a user interface including a touch screen and including a second number of physical selectors, which is less than the first number of physical selectors, wherein at least one of the game programs:

requires game bet selectors and a game play actuator that number more than the second number of physical selectors provided on the second type of console and number less than or equal to the first number of physical selectors provided on the first type of console; and comprises a game parameter that causes the game controller running the game program to be manually or automatically configurable dependent on a manual or automatic determination of whether the console on which the game is to provided is of the first type or the second type, between a first configuration in which only the physical selectors of the first type of gaming console are used to implement the game bet selectors and the game play actuator and a second configuration in which the touch screen of the second type of console is used to implement the game bet selectors and one of the physical selectors of the second type of console is used to implement the game play actuator.

In one embodiment, at least two of the game programs comprise the configurable game parameter.

In one embodiment, the user interface of the first type of console further comprises a touch screen and wherein when the game controller is configured in the first configuration, one or more selectors other than the game bet selectors and the game play actuator are provided using the touch screen of the first type of console.

According to a sixth aspect of the invention, there is provided a method of configuring a gaming machine to run a game program, the method comprising:

determining whether a gaming console of the gaming machine has a touch screen;

if the gaming console has a touch screen, causing a game program to control a game controller to implement a user interface on the gaming console using the touch screen;

if the gaming console does not have a touch screen, causing said game program to control a game controller to implement a user interface without using a touch screen.

According to a seventh aspect of the invention, there is provided a method of configuring a gaming machine, the method comprising:

determining whether a gaming console of the gaming machine has sufficient buttons to play a game;

if the gaming console has insufficient buttons, causing a game program of said game to implement a user interface using a touch screen;

if the gaming console does have sufficient buttons, causing said game program to implement a user interface without using a touch screen.

In one embodiment, if the gaming console has insufficient buttons, the user interface implemented using the touch screen is a partial user interface that comprises game bet selectors and not a dedicated game play activator and wherein when the user interface is implement using a touch screen, the method further comprises causing said game program to control a game controller to detect actuation of a physical button as a game play activator.

According to an eighth aspect of the invention, there is provided a method of providing a game on a gaming machine, the method comprising:

providing a game program comprising instructions to cause a game controller to implement a game on the gaming machine and comprising a configurable game parameter that configures the game controller to recognise inputs from different user interfaces;

identifying the number of player operable selectors required to implement game bet selectors and a game play actuator of the game;

determining whether a gaming console of the gaming machine has sufficient physical selectors to provide all the game bet selectors and the game play actuator;

if the gaming console has insufficient physical selectors, configuring the game controller to recognise inputs from a touch screen in addition to inputs from the physical selectors of the gaming console so as to provide all the required selectors; and if the gaming console has sufficient physical selectors, configuring the game controller to recognise inputs from the physical selectors for the game bet selectors and the game play actuator.

In one embodiment, if the gaming console has insufficient physical selectors, the inputs recognised from the touch screen comprise game bet selectors and not a game play activator and an input recognised from the physical selectors is a game play activator.

In one embodiment, configuring the game controller comprises placing the game controller in a configuration mode and manually selecting the configuration of the game controller. In another embodiment, configuring the game controller comprises the game controller determining the number of physical selectors provided on a gaming console, comparing the number provided with the number of game bet selectors plus game play actuator required, and selecting the configuration based on the determination and comparison.

Further aspects of the present invention and further embodiments of the aspects described in the preceding paragraphs will become apparent from the following description, given by way of example and with reference to the accompanying drawings.

BRIEF DESCRIPTION OF THE DRAWINGS

Notwithstanding any other embodiments that may fall within the scope of the present invention, certain embodiments of the present invention will now be described, by way of example only, with reference to the accompanying figures, in which.

DESCRIPTION OF THE INVENTION

Figure 1:
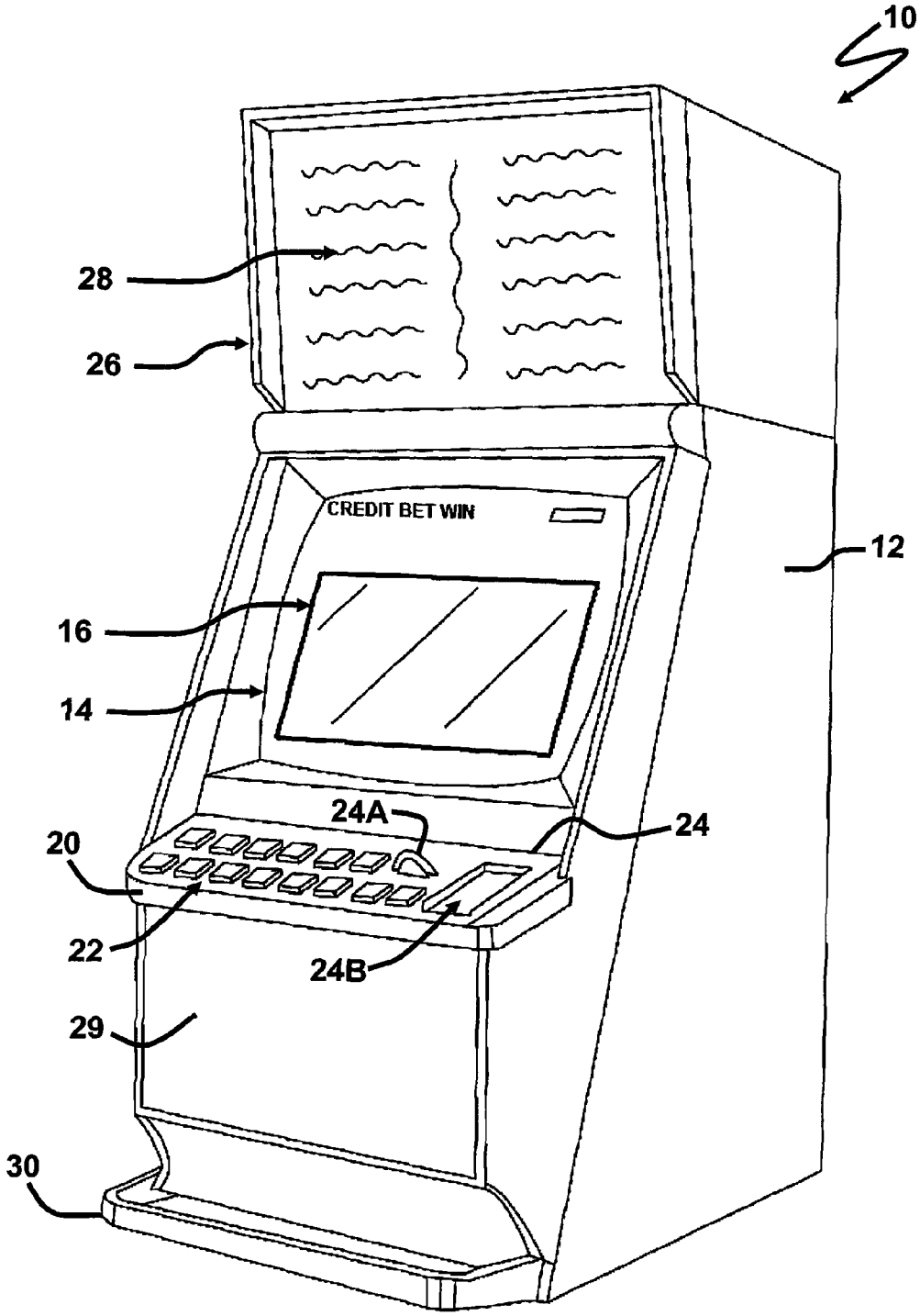
FIG. 1 shows, diagrammatically, a view of a gaming machine suitable for implementing an embodiment of the present invention.

Throughout the following description and in the accompanying drawings, unless stated otherwise, like reference numerals refer to like components.

In FIG. 1 of the accompanying drawings, one example of a gaming machine suitable for implementing an embodiment of the present invention is generally referenced by arrow 10.

The gaming machine 10 includes a console 12 having a display 14 on which is displayed representations of a game 16 that can be played by a player. A mid-trim 20 of the gaming machine 10 houses a bank of buttons 22 for enabling a player to play the game 16. The bank of buttons 22 of the gaming machine 10 has fourteen buttons, which is common to gaming machines at present.

The mid-trim 20 also houses a credit input mechanism 24 including a coin input chute 24A and a bill collector 24B. A top box 26 may carry artwork 28, including for example, pay tables and details of bonus awards and other information or images relating to the game. Further artwork and/or information may be provided on the front panel 29 of the console 12. A coin tray 30 is mounted beneath the console 12 for cash payouts from the gaming machine 10.

The display 14 shown in FIG. 1 is in the form of a video display unit, particularly a cathode ray tube screen device. Alternatively, the display 14 may be a liquid crystal display, plasma screen, any other suitable video display unit, or the visible portion of an electromechanical device. As explained in more detail herein, the display 14 may not include a touch screen, because the gaming machine 10 has a full set of buttons in its bank of buttons 22. However, the display 14 may be a touch screen. The top box 26 may also include a display, for example a video display unit, which may be of the same type as the display 14, or a different type of display.

Figure 2A:
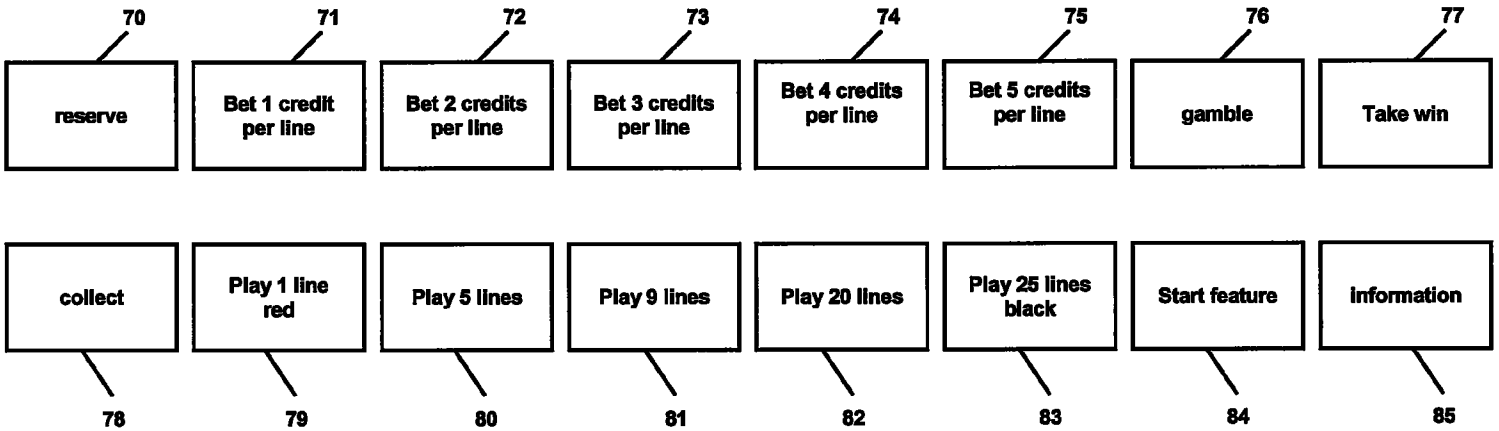
FIGS. 2A and 2B show enlarged plan views of a sixteen button bank of buttons and a seven button bank of buttons respectively.

FIG. 2A shows an expanded plan view of a bank of buttons 22A for an exemplary game playable on a gaming machine similar to the gaming machine 10 shown in FIG. 1, but with a sixteen button bank of buttons instead of a fourteen button bank of buttons. The bank of buttons 22A is suited for a gaming machine that provides a game having the following characteristics:

a) A twenty-five line spinning reel type game, with the number of lines played selected by pressing one of the buttons 79 to 83;

b) A maximum bet of five credits per game, with the bet per line selected by pressing one of the buttons 71 to 75;

c) A feature game, the commencement of the feature game controlled by the player by pressing button 84;

d) A reserve function, which is initiated by pressing button 70;

e) An option to perform a red/black gamble following a win, the option taken by pressing button 76;

f) Game play is initiated by placing a line bet.

In addition, the bank of buttons 22A includes a collect (button 78) and take win (button 77) buttons as well as an information button 85. Therefore, the bank of buttons 22A operates in a typical and known manner for a game having the characteristics described previously herein. Further selectors may be provided using a touch screen if one is provided and if additional selectors are implemented by the game being played by the gaming console.

Figure 2B:
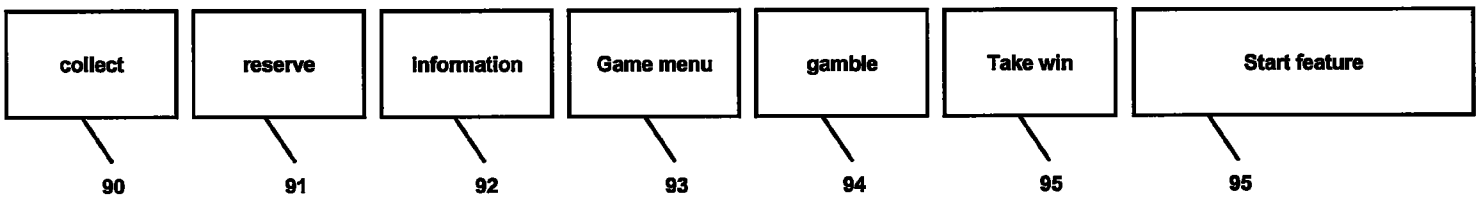

FIG. 2B shows a bank of buttons 22B for an exemplary game playable on a gaming machine similar to the gaming machine 10 shown in FIG. 1, but with the bank of buttons 22 replaced with the bank of buttons 22B. The bank of buttons 22B has seven buttons and is suited for a gaming machine that having the following characteristics:

a) A multi-game machine, providing a choice of games, the player accessing a menu of available games by pressing button 93;

b) At least one of the games having a feature game, the commencement of the feature game controlled by the player by pressing button 96;

d) A reserve function, which is initiated by pressing button 91;

e) An option to perform a red/black gamble following a win, the option taken by pressing button 94;

f) Game play is initiated by placing a line bet.

As explained in more detail herein, if a gaming machine with the bank of buttons 22B is to play a game that is a 25 line spinning reel game with a maximum bet of five credits per line, then the game bet selection buttons would be implemented as a touch screen. For example buttons equivalent to buttons 71 to 75 and 79 to 83 of FIG. 2A would be provided on screen.

Those skilled in the relevant arts will appreciate that the buttons provided and the functions performed by each button may vary, for example due to convention, regulations or other reasons in different jurisdictions, depending on the particular game being played or according to different manufacturer preferences or choices.

Figure 3:
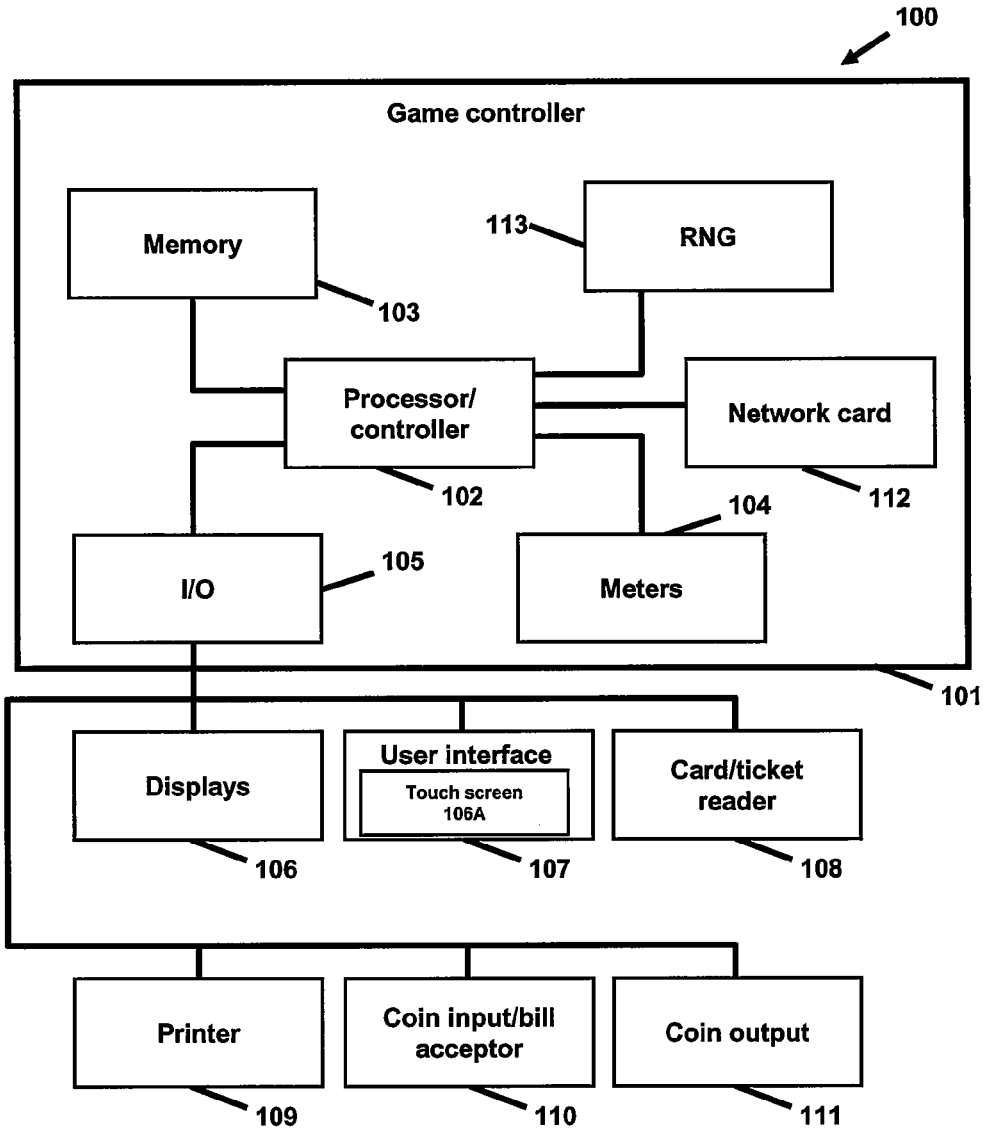
FIG. 3 shows a block diagram of gaming apparatus suitable for implementing an embodiment of the present invention.

FIG. 3 shows a block diagram of a gaming machine, generally referenced by arrow 100, suitable for implementing an embodiment of the present invention. The gaming machine 100 may, for example, operate as a standalone gaming machine of the type shown in FIG. 1. However, the gaming apparatus 100 may alternatively operate as a networked gaming machine, communicating with other network devices, such as one or more servers or other gaming machines. The gaming apparatus 100 may also have distributed hardware and software components that communicate with each other directly or through a network. Accordingly, different reference numerals have been used in FIG. 3 from FIGS. 1 and 2 for components that may be equivalent.

The gaming machine 100 includes a game controller 101, which in the illustrated example includes a microprocessor, microcontroller, programmable logic device or other computational device 102. Instructions and data to control operation of the computational device 102 are stored in a memory 103, which is in data communication with the computational device 102. Typically, the gaming apparatus 100 will include both volatile and non-volatile memory and more than one of each type of memory, with such memories being collectively represented by the memory 103. The instructions to cause the game controller 101 to implement certain embodiments of the present invention will be stored in the memory 103.

The game controller 101 may also include a random number generator 113, which generates a series of random numbers that determine the outcome of a series of random game events played as part of a game on the gaming machine 100.

The gaming machine 100 may include hardware meters 104 for the purposes of regulatory compliance and also include an input/output (I/O) interface 105 for communicating with the peripheral devices of the gaming apparatus 100. The input/output interface 105 and/or the peripheral devices may be intelligent devices with their own memory for instructions and data.

In the example shown in FIG. 3, the peripheral devices that communicate with the controller are one or more displays 106, user interfaces 107, a card and/or ticket reader 108, a printer 109, a bill acceptor and/or coin input mechanism 110 and a coin output mechanism 111. The display or displays 106 may include a touch screen 106A to provide part of the user interface 107. Additional devices may be included as part of the gaming apparatus 100, or devices omitted as required for the specific implementation.

In addition, the gaming machine 100 may include a communications interface, for example a network card 112. The network card, may for example, send status information, accounting information or other information to a central controller, server or database and receive data or commands from the central controller, server or database. As explained in more detail in relation to FIG. 5, the computational device 102 may include two or more controllers or processors, which may be local or remote from each other and the displays 106.

Figure 4:
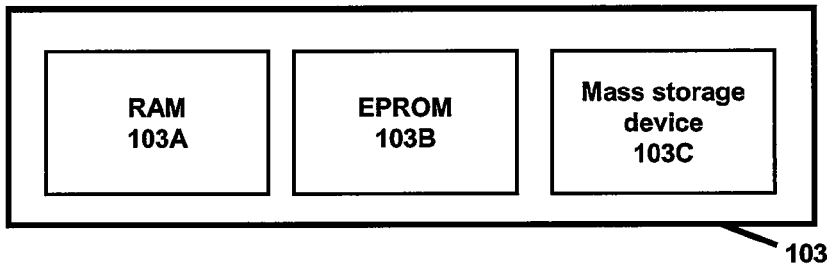
FIG. 4 shows a block diagram of components of the memory of the gaming apparatus represented in FIG. 2.

FIG. 4 shows an exemplary block diagram of the main components of the memory 103. The RAM 103A typically temporarily holds program files for execution by the computational controller 102 and related data. The EPROM 103B may be a boot ROM device and/or may contain some system or game related code. The mass storage device 103C is typically used to store game programs, the integrity of which may be verified and/or authenticated by the computational controller 102 using protected code from the EPROM 103B or elsewhere.

Figure 5:
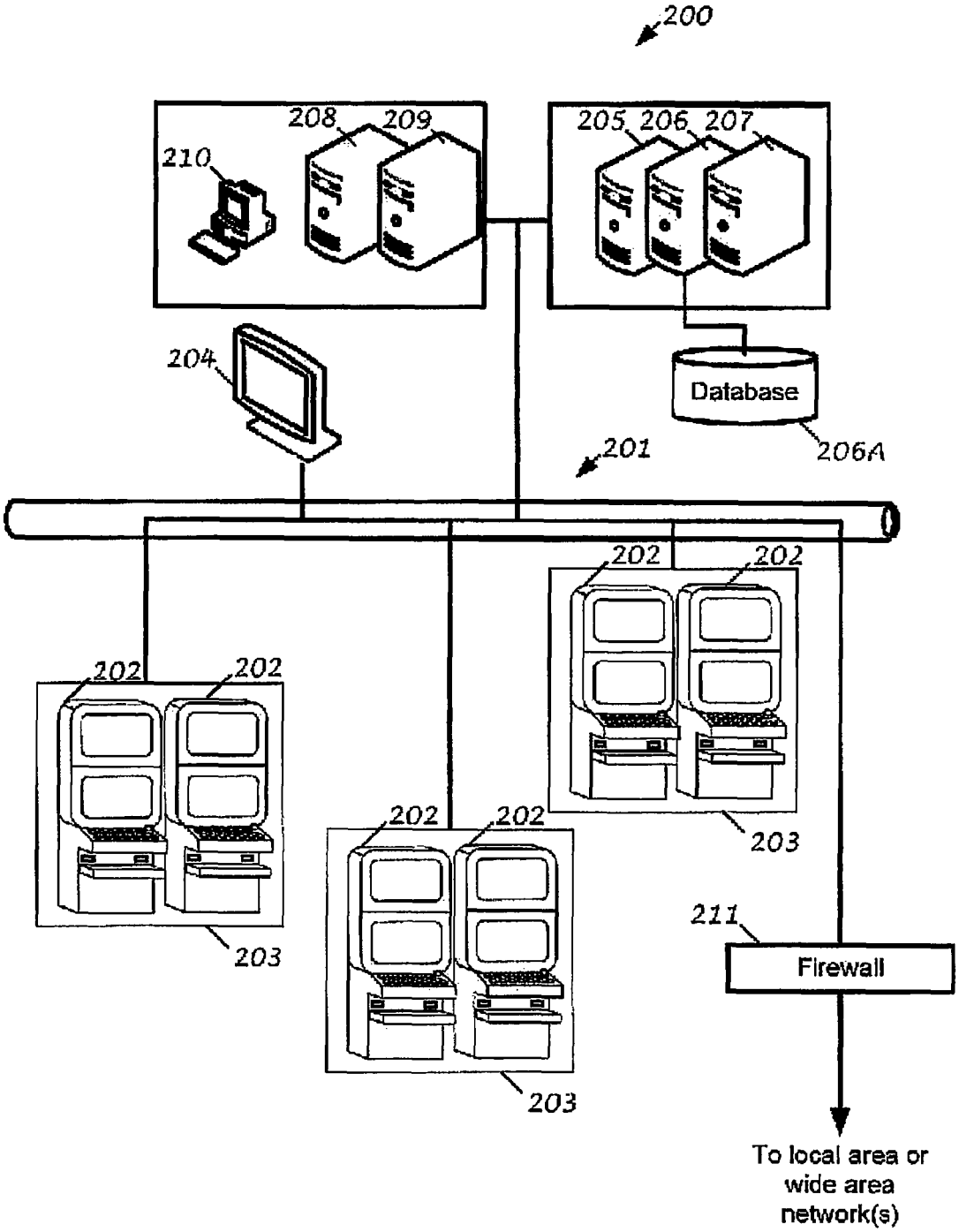
FIG. 5 shows, diagrammatically, a network gaming system suitable for implementing an embodiment of the present invention.

FIG. 5 shows a gaming system 200, which is an environment in which certain embodiments of the present invention may be implemented. The gaming system 200 includes a network 201, which for example may be an Ethernet network. Gaming devices 202, shown arranged in three banks 203 of two gaming devices 202 in FIG. 5, are connected to the network 201. The gaming devices 202 may be gaming machines 10, as shown in FIG. 1, or form part or all of another gaming apparatus 100. Single gaming devices 202 and banks 203 containing three or more gaming devices 202 may also be connected to the network 201.

One or more displays 204 may also be connected to the network 201. The displays 204 may, for example, be associated with a bank 203 of gaming devices 202. The displays 204 may be used to display representations associated with game play on the gaming devices 202, and/or used to display other representations, for example promotional or informational material.

Servers may also be connected to the network 201. For example, a game server 205 may generate game outcomes for games played on the gaming devices 202, a database management server 206 may manage the storage of game programs and associated data for downloading or access by the gaming devices 202 in a database 206A, and a jackpot server 207 may control one or more jackpots associated with the gaming devices 202.

Further servers may be provided to assist in the administration of the gaming system 200, including for example a gaming floor management server 208, and a licensing server 209 to monitor the use of licenses to particular games. An administrator terminal 210 is provided to allow an administrator to run the network 201 and the devices connected to the network.

The gaming system 200 may communicate with other gaming systems, other local networks, for example a corporate network and/or a wide area network such as the Internet through a firewall 211.

Figure 6:
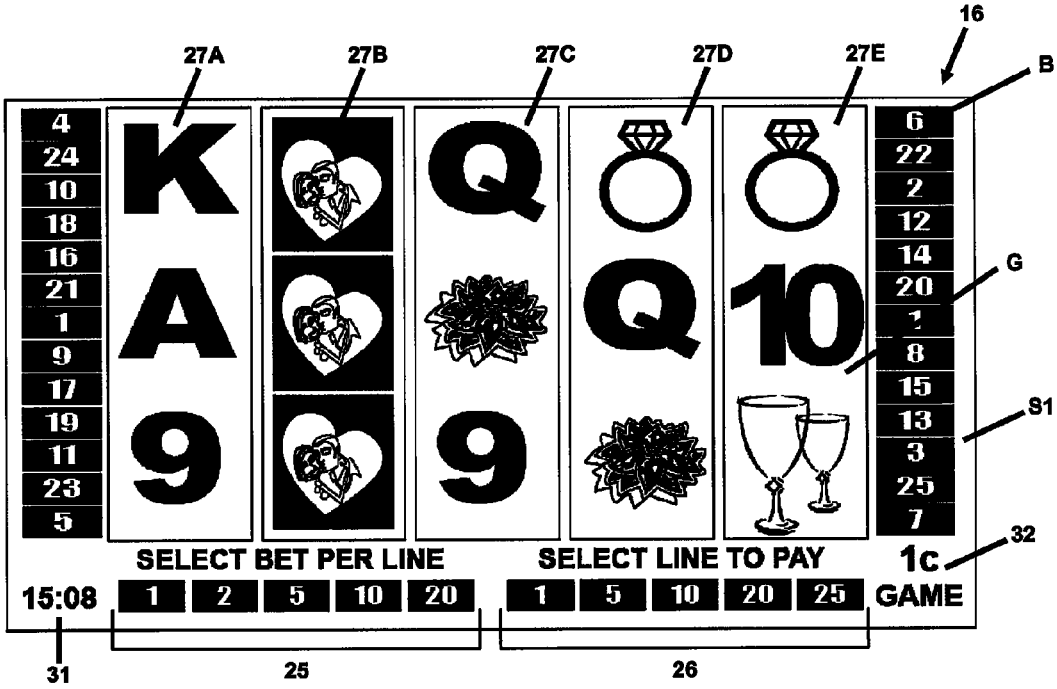
FIGS. 6 to 8 show exemplary screen shots displayed by a game in accordance with certain embodiments of the present invention.
Figure 7:
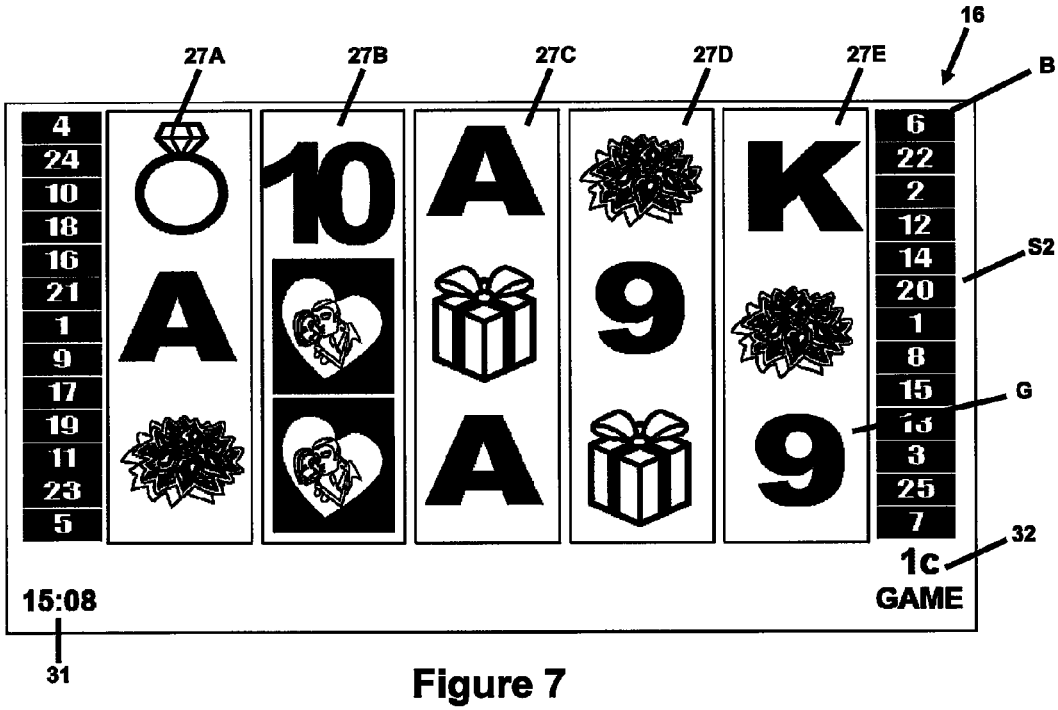
Figure 8:
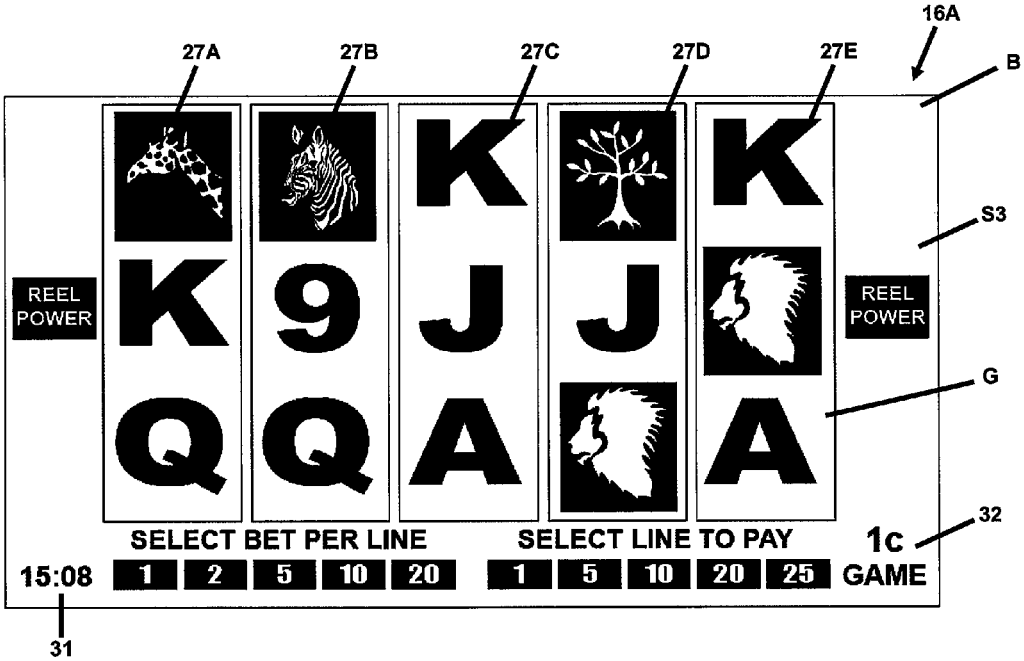

Exemplary screen shots S1 to S3 that are caused to be displayed by game programs in accordance with certain embodiments of the present invention are shown in FIGS. 6 to 8. The game programs may be stored in firmware, for example in the EPROM 103B on a gaming device 202, stored in mass storage device 103C, either on a gaming device 202, or remotely from the gaming device 202, for example in the database 206A. The game may be executed, for example, by the computational device 102, the game server 205, or by a combination thereof.

FIG. 6 shows a screen display S1 of a game 16 in a first mode of operation. The first mode of operation may be used, for example, when the game is to be executed by a gaming machine having a seven button bank of buttons 22B (see FIG. 2B). The bank of buttons 22B has an insufficient number of buttons to implement the game and the gaming machine has a display 14 with a touch screen 106A. Therefore, the game bet selection buttons are implemented using the touch screen 106A. The player of the game can therefore select the bet per line and the number of lines to play by selecting one of the five touch pads 25 and 26 respectively. Once the number of lines and bet per line has been selected the game either starts automatically, or the player then activates the game by selecting a "SPIN" button (see FIG. 10) in the bank of buttons. This will cause the reels 27A-27E to be represented on the display 14 as spinning reels, stopping in a position randomly determined by the computational controller 101, thereby revealing a random selection of symbols.

Screen display S1 shows a preferred embodiment of the present invention as presently contemplated, in which the user interface provides to the player distinct buttons for each bet option. This is in contrast, for example, to providing for example two buttons, one for increasing a wager amount and the other for decreasing a wager amount. The applicant believes that the provision of distinct buttons gives the player an optimal feeling of easy and fast control over game play.

FIG. 7 shows a screen display of the game 16 in a second mode of operation. The game is played in the same manner as described herein above in relation to FIG. 6 except that the game selection buttons are not implemented on the touch screen. The game selection buttons are instead implemented elsewhere. Suitably, the game selection buttons may be implemented as part of the bank of buttons 22.

In an alternative embodiment, the gaming apparatus may have the bank of buttons 22B and a touch screen that is separate from the display 14. In this case, the operation of the game 16 is as described for the second mode of operation, the only difference being that the button depress signal for the game selection buttons comes from a touch screen instead of a physical button. Generally speaking, the game 16 operates in the second mode of operation when the user interface of the gaming apparatus has a touch screen and has insufficient physical buttons to adequately implement the game.

FIG. 8 shows a screen shot of another game 16A. This game operates by a player selecting combinations of reels instead of pay lines. The player can choose anywhere between one and all five reels using the touch pads 25A and can adjust the magnitude of the wager using the touch pads 26A. A winning combination can be formed by symbols appearing in any of the three displayed position on each reel. Therefore, if reel one is selected, then three combinations of symbols are formed, which are evaluated for a winning combination. If reels one and two are selected, nine combinations are formed, if reels one to three selected 27 combinations are formed, if reels one to four selected, 81 combinations are formed and if all five reels are selected, 243 combinations are selected. More details on this method of playing a game are provided in Australian patent number 684233.

The screen displays S1 to S3 all show a clock 31 and a denomination 32 of the game in addition to the game screen. Also, the game selection buttons, or at least the area surrounding the game selection buttons, are displayed so as to appear semi-transparent. This may be achieved by assigning an alpha value to the images. In this way, game selection buttons are automatically matched to a background scene B that may be provided behind the game screen G, due to the background scene being partially viewable through the game selection buttons. This may allow the software code for the game selection buttons to be readily used with multiple different game programs. The software that causes the display of the icons for the touch screen and the ability to turn this display on and off, may be contained in a self-contained piece of code. This may facilitate use of the same or similar code across multiple games.

The game screens G of different games preferably occupy the same area and location on the screen display and leave room for the game selection buttons to be displayed. This had the advantages of avoiding having to change the program code to resize the game screen G when a touch screen is required and allows game screens to be standardized.

Certain embodiments of the present invention may also have application to games where symbols are randomly selected and evaluated for a winning combination that are not spinning reel games. For example, the present invention will also have application to card games, poker-style or otherwise, dice games, pin and ball style games and others.

Figure 9:
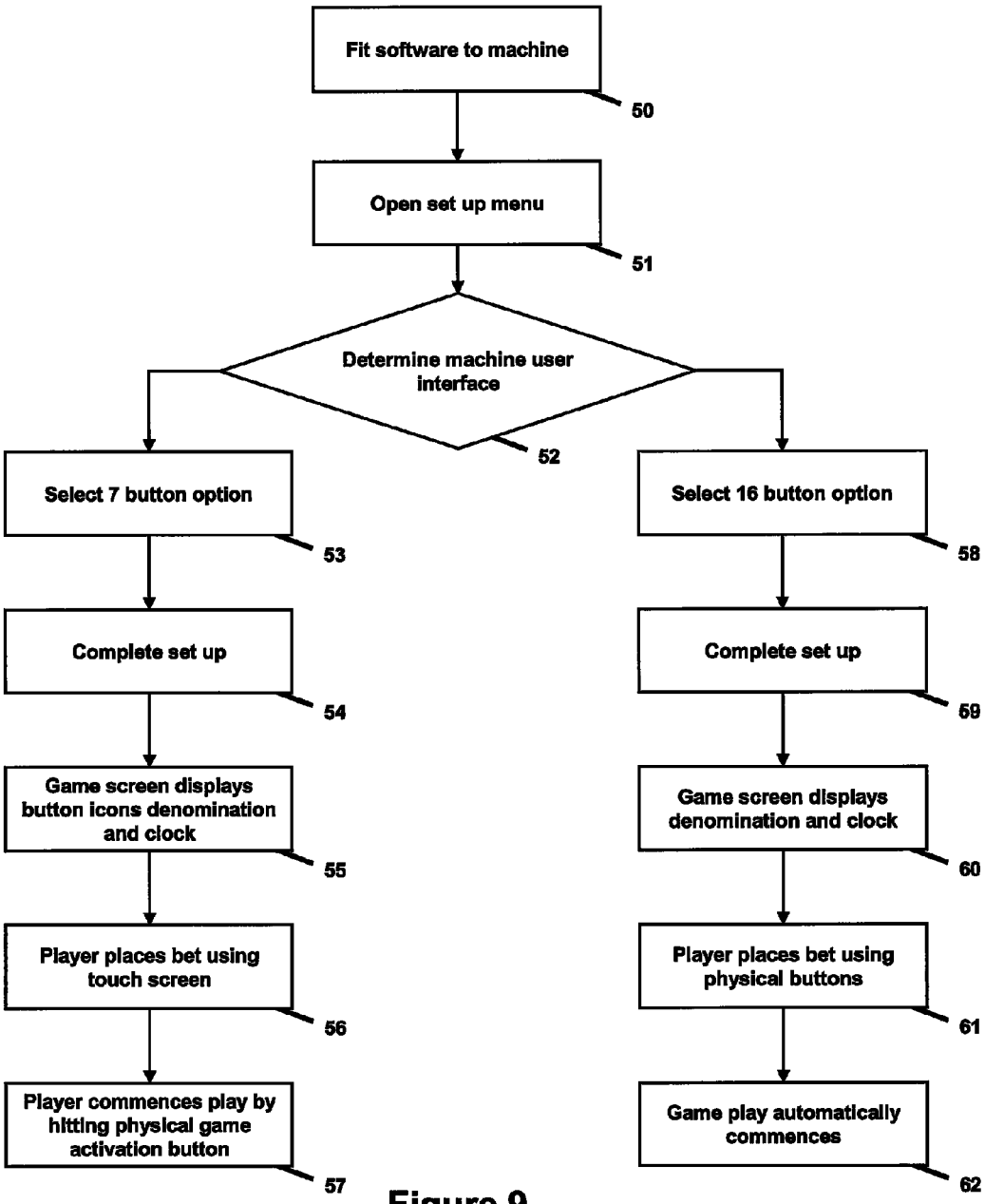
FIG. 9 shows a high level flow diagram of an exemplary game loading and play process according to an embodiment of the present invention.

FIG. 9 shows a flow chart of the steps performed to install and play game software of certain embodiments of the present invention. In step 50, the game software, which if intended for a gaming machine is currently typically implemented in firmware, is fitted to the machine. The game software may comprise a plurality of games if the gaming machine is to be multi-game machine. Alternatively, where the gaming device is a networked gaming machine, console or other device, step 50 may comprise downloading the game to the gaming device or uploading a game from a database to a game server. FIG. 9 assumes that the game is implemented in firmware.

In step 51, the operator of the gaming device opens a set-up menu and in step 52 the operator determines whether the gaming device is one with seven physical buttons (or other number of buttons insufficient for play of a game required to be provided on the gaming device) and a touch screen, or sixteen physical buttons. This step may be performed automatically if the gaming device stores data, or has a jumper or other hardware, that indicates its configuration. If the game is downloaded to the gaming machine, or executed remotely, the configuration of the game may be performed remotely. The gaming machine may, in response to an interrogation, send information regarding its user interface to a download server so that the appropriate configuration may be made.

If the gaming device has seven buttons, the operator selects this option in the set up menu (step 53) and then completes the other necessary set-up (step 54) and exits the set-up menu. The gaming device then displays in the appropriate place icons for the touch pads, the denomination of the game, and a clock (step 55). The display of the clock may be omitted if the relevant gaming regulations permit this.

A player plays the game in steps 56 and 57 by first using the game bet selection buttons on-screen to specify the wager that they wish to make, and hitting a physical button in the bank of buttons 22B to commence play. The player can then repeat steps 56 and 57 for each play of the game, or simply repeat step 57 if they do not wish to change their wager.

If the gaming device has sixteen buttons, the operator selects the 16 button option in the set up menu (step 58) and then completes the other set-up action in step 59 and exits the set-up menu. The denomination of the game and a clock is displayed (step 60) in the same manner as for the seven button option, but icons for the touch screen are not displayed.

A player plays the game by using game bet selection buttons in the bank of buttons 22 (step 61), after which game play may commence automatically (step 62). The player can then repeat step 61 for each play of the game. If the gaming machine has a separate "spin" button, then pressing this button commences game play.

Figure 10:
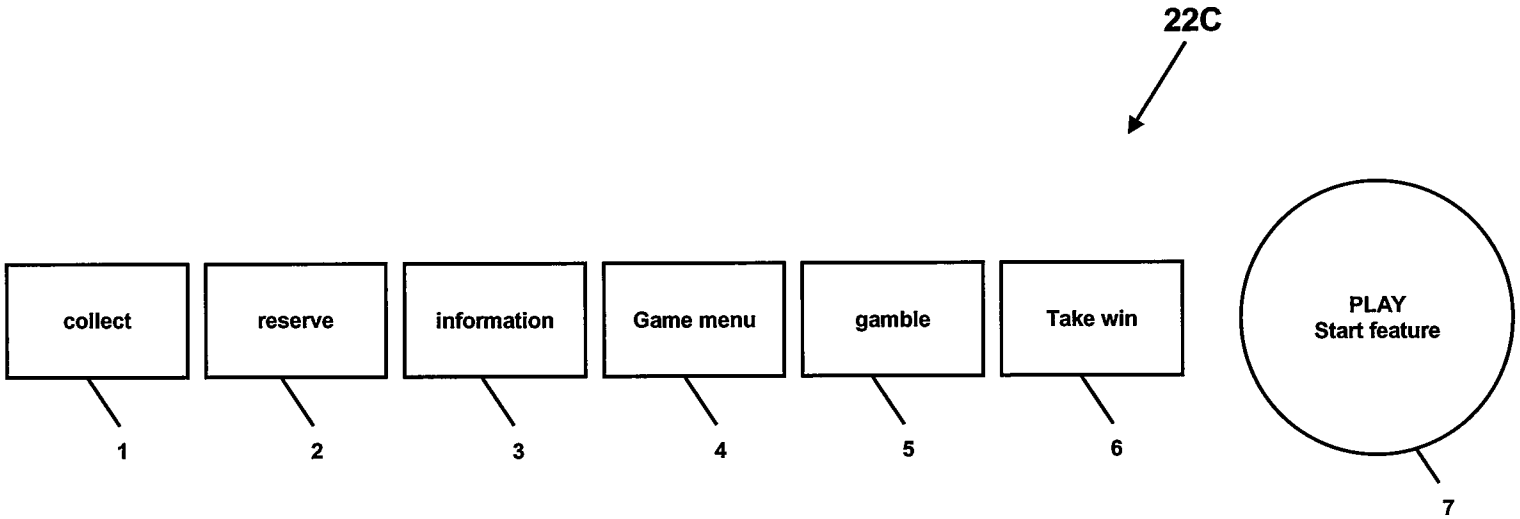
FIG. 10 shows an example of a seven button bank of buttons including a game play activator button in accordance with one embodiment of the invention.

FIG. 10 shows a plan view of an example of a bank of buttons 22C that may be provided on a gaming machine 100 that provides games in accordance with the present invention. The bank of buttons 22C include buttons 1-6, which perform the same function as buttons 90-95 shown in FIG. 2B. Button 7 also operates to start a feature game, but in addition is a game play activator button (PLAY). When games are provided by the gaming machine with the bank of buttons 22C, which require game bet selectors, these are displayed on a display including a touch screen (see for example FIGS. 6 and 8). The player can then select the number of lines, number of reels or other indicator of the number of bets to place and/or select the amount staked per bet using the touch screen. Following this the player selects the PLAY button to initiate a game play with the selected bet and may continue playing games with the same wager option by repeatedly pressing the PLAY button. When the player wishes to change his or her bet selection, he or she presses one of the game bet selectors displayed on the display.

In one embodiment the PLAY button, being the game play actuator, may be an enlarged button in comparison to any other buttons in the bank of buttons 22C. As this button is usually the most often selected button, it may also be constructed so as to be the most durable button.

While the foregoing description has been provided by way of example of the preferred embodiments of the present invention as presently contemplated, which utilise gaming apparatus and machines, those skilled in the relevant arts will appreciate that the present invention also may have application to internet gaming, particularly where the gaming is performed using kiosks having various button configurations and/or have application to gaming over a telecommunications network, where handsets are used to display game outcomes and receive player inputs. In particular, for handsets with a touch screen, the user interface may be implemented in part by a touch screen and for those without a touch screen the user interface may be implemented using buttons provided on the handset.

Where in the foregoing description reference has been made to integers having known equivalents, then those equivalents are hereby incorporated herein as if individually set forth.

Those skilled in the relevant arts will appreciate that modifications and additions to the embodiments of the present invention may be made without departing from the scope of the present invention as defined in the appended claims.

It will be understood that the invention disclosed and defined in this specification extends to all alternative useful combinations of two or more of the individual features mentioned or evident from the text or drawings. All of these different combinations constitute various alternative aspects of the invention.

It will also be understood that the term "comprises" (or its grammatical variants) as used in this specification is equivalent to the term "includes" and should not be taken as excluding the presence of other elements or features.

The invention claimed is:

1. A programmed controller of a gaming console, the gaming console having a game display and a number of physical buttons forming at least in part a user interface, wherein the controller is programmed so as to:

receive information relating to a player input provided through a user interface in communication with the controller;

dependent at least in part on the player input, control play of a game in which a plurality of symbols are selected to form one or more outcomes;

if at least one particular outcome results in the play of the game, cause the award of an award;

cause the game display to display representations of the game; and selectively operate in a first mode of operation or in a second mode of operation;

wherein the selected mode of operation is automatically determined by the gaming console to operate in the first mode of operation when the gaming console has an insufficient number of physical buttons to adequately implement the game; and wherein in the first mode of operation, the user interface comprises a combination of the physical buttons on the gaming console and additional buttons implemented on the game display; and wherein in the second mode of operation, the user interface is separate from the game display.

2. The programmed controller of claim 1, wherein in the first mode of operation, the game display implements game bet selectors and the physical buttons implement a game play activator.

3. The programmed controller of claim 2, wherein the game bet selectors are the only selectors implemented using the game display.

4. The programmed controller of claim 1, and being further programmed so as to enter a configuration mode when a particular input is received, wherein in response to receipt of a further particular input when in the configuration mode, the programmed controller is configured to operate in either the first mode of operation or the second mode of operation.

5. A programmed game controller for a gaming console, the gaming console having a game display and a number of physical buttons forming at least in part a user interface, wherein the controller is programmed so as to:

receive through a user interface in communication with the programmed game controller a selection of a number of outcomes of a game on which a player stakes a wager and a selection of the size of the wager staked on each outcome;

dependent at least in part on the received selections, control play of a game to form a plurality of outcomes and cause a plurality of symbols representing the outcomes to be displayed on a game display to represent each outcome;

if an outcome on which the player has staked a wager is a winning outcome, cause the award of an award; and selectively operate in one of a first mode of operation and a second mode of operation, the selected mode of operation being automatically determined by the gaming console to operate in the first mode of operation when the gaming console has an insufficient number of physical buttons to adequately implement the game; and wherein in the first mode of operation, the user interface comprises a combination of the physical buttons on the gaming console and a touch screen provides over the game display;

detects operation of the touch screen provided over the game display and determines from operation of the touch screen the number of outcomes on which a player stakes a wager and the size of the wager per outcome, and causes the game display to display behind the touch screen buttons with explanatory information that indicate how the touch screen should be operated to stake a particular wager; and detects actuation of at least one of the physical buttons and plays a game in accordance with a wager previously specified by operation of the touch screen upon actuation of at least one of the physical buttons;

and wherein in the second mode of operation the game controller, the user interface is separate from the game display:

does not cause the display to display the wagering buttons;

detects actuations of at least one of the physical buttons;

determines from actuations of the at least one of physical buttons the number of outcomes on which a player stakes a wager and the size of the wager per outcome; and plays a game in accordance with a specified wager upon actuation of the at least one of the physical buttons.

6. The programmed controller of claim 5, wherein when the touch screen buttons and explanatory information are displayed, the programmed controller causes them to be displayed on a portion of the screen that is not occupied by any symbols representing the outcomes of the game and wherein when the touch screen buttons and explanatory information are not displayed, the only change made to the images displayed on the display is the display of images in the location where the touch screen buttons and explanatory information would be displayed.

7. The programmed controller of claim 1 wherein said game is one of a plurality of games that the programmed controller is programmed to provide, each of the plurality of games being controlled in part dependent on inputs received from the user interface and wherein the selected mode of operation is further dependent on the game being played by the gaming console.

8. A gaming system comprising a computer server in communication with both a plurality of gaming consoles and a database containing a plurality of game programs, wherein each of the game programs, when executed by a game controller in the gaming network, provides a game on a said console in which a plurality of symbols are selected to form one or more outcomes and if a particular outcome results an award is awarded, wherein the plurality of gaming consoles comprise at least one console of a first type and at least one console of a second type, the first type of console comprising a user interface including a first number of physical selectors, and the second type of console comprising a user interface including a touch screen and including a second number of physical selectors, which is less than the first number of physical selectors, and wherein at least one of the game programs:

requires game bet selectors and a game play actuator that number more than the second number of physical selectors provided on the second type of console and number less than or equal to the first number of physical selectors provided on the first type of console; and comprises electronic game parameter data that causes the game controller running the game program in the second type of console when the console has an insufficient number of physical buttons to adequately implement the game to implement the game bet selectors and the game play actuator, the user interface comprises a combination of the available physical buttons on the gaming console and additional buttons implemented on the console, and a second configuration in which the user interface comprises the physical buttons on the game console, the touch screen of the second type of console is used to implement the game bet selectors and one of the physical selectors of the second type of console is used to implement the game play actuator.

9. The gaming system of claim 8, wherein at least two of the game programs comprise the configurable game parameter.

10. The gaming system of claim 8, wherein the user interface of the first type of console further comprises a touch screen and wherein when the game controller is configured in the first configuration, one or more selectors other than the game bet selectors and the game play actuator are provided using the touch screen of the first type of console.

11. A method of configuring a gaming console, the gaming console having a game display and a number of physical buttons forming at least in part a user interface to run a game program, the method comprising:

evaluating electronic configuration parameter data associated with a gaming console, said evaluating determining whether the gaming console incorporates a touch screen and whether the gaming console has a sufficient number of physical buttons to run the game program;

in response to determining that the gaming console incorporates a touch screen and that the gaming console has an insufficient number of physical buttons to run the game program, causing a game program to control a game controller to implement a user interface on the gaming console using a combination of physical buttons on the gaming console and additionally buttons implemented on the touch screen;

in response to determining that the gaming console does not incorporate a touch screen, causing said game program to control a game controller to implement a user interface is separate from the game display without using a touch screen.

12. A method of providing a game on a gaming machine, the gaming machine having a game display and a number of physical buttons forming at least in part a user interface, the method comprising:

providing a game program comprising instructions to cause the game controller to implement a game on the gaming machine and comprising a configurable game parameter that configures the game controller to recognise inputs from different user interfaces;

identifying the number of player operable selectors required to implement game bet selectors and a game play actuator of the game;

determining whether a gaming console of the gaming machine has sufficient physical selectors to provide all the required game bet selectors and the game play actuator;

if the gaming console has insufficient physical selectors, configuring the game controller to recognise a combination of inputs from buttons implemented on a touch screen in addition to inputs from the available physical selectors of the gaming console so as to provide all the required selectors; and if the gaming console has sufficient physical selectors, configuring the game controller to recognise inputs from the physical selectors for the game bet selectors and the game play actuator, wherein configuring the game controller further comprises the game controller automatically determining the number of physical selectors provided on the gaming console, comparing the number provided with the number of game bet selectors plus game play actuator required, and selecting the configuration based on the determination and comparison.

13. The method of claim 12, wherein if the gaming console has insufficient physical selectors, the inputs recognised from the touch screen comprise game bet selectors and not a game play activator and an input recognised from the physical selectors is a game play activator.

14. The programmed controller of claim 1, wherein in the second mode of operation, the user interface comprises only the physical buttons of the gaming console.

* * * * *